US008991973B1

(12) United States Patent
Sugiura et al.

(10) Patent No.: US 8,991,973 B1
(45) Date of Patent: Mar. 31, 2015

(54) LIQUID EJECTION APPARATUS

(71) Applicant: Brother Kogyo Kabushiki Kaisha, Nagoya-shi, Aichi-ken (JP)

(72) Inventors: Keita Sugiura, Toyoaki (JP); Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/327,841

(22) Filed: Jul. 10, 2014

(30) Foreign Application Priority Data

Sep. 27, 2013 (JP) ..... 2013-201100

(51) Int. Cl.
*B41J 2/165* (2006.01)

(52) U.S. Cl.
CPC ..... *B41J 2/16505* (2013.01)
USPC ..... 347/29

(58) Field of Classification Search
None
See application file for complete search history.

(56) References Cited

U.S. PATENT DOCUMENTS

| | | | | |
|---|---|---|---|---|
| 7,922,282 | B2 * | 4/2011 | Shindo et al. | 347/29 |
| 8,025,360 | B2 * | 9/2011 | Takahashi | 347/29 |
| 8,382,236 | B2 * | 2/2013 | Shimazaki | 347/29 |
| 2005/0093939 | A1 | 5/2005 | Takagi | |
| 2009/0002467 | A1 | 1/2009 | Watanabe | |

FOREIGN PATENT DOCUMENTS

| | | |
|---|---|---|
| JP | 2005/132025 | 5/2005 |
| JP | 2006/256129 | 9/2006 |
| JP | 2009/029111 | 2/2009 |
| JP | 2011/063031 | 3/2011 |
| JP | 2011/245733 | 12/2011 |

* cited by examiner

*Primary Examiner* — Lamson Nguyen
(74) *Attorney, Agent, or Firm* — Frommer Lawrence & Haug LLP

(57) ABSTRACT

A liquid ejection apparatus includes: a head including an ejection surface, an internal passage and ejection openings; a cap mechanism including a facing member and an elastic member; and a controller for: performing an ejection-opening purging operation for, after establishing a first isolated state of an ejection space, discharging liquid from the ejection openings by establishing an isolating state of a discharge passage in a state in which the liquid in a tank is supplied to the internal passage by a pump; and thereafter stopping the liquid in the tank from being supplied to the internal passage. The controller controls the cap mechanism in the ejection-opening purging operation to switch the ejection space from the first isolated state to a second isolated state in which the ejection space is isolated, with the facing member spaced from the ejection surface at a greater distance than in the first isolated state.

16 Claims, 13 Drawing Sheets

⊗——→ MAIN SCANNING DIRECTION

SUB-SCANNING DIRECTION

LIQUID EJECTION APPARATUS

CROSS REFERENCE TO RELATED APPLICATION

The present application claims priority from Japanese Patent Application No. 2013-201100, which was filed on Sep. 27, 2013, the disclosure of which is herein incorporated by reference in its entirety.

BACKGROUND

1. Technical Field

The present invention relates to a liquid ejection apparatus configured to eject liquid from ejection openings.

2. Description of the Related Art

There is conventionally known an ink-jet head configured to eject ink droplets from a multiplicity of ejection openings and configured to clean the ejection openings by driving a pump to force ink into head passages formed in the ink-jet head to discharge, from the ejection openings, air bubbles and high-viscosity ink existing in portions of the head passages near the ejection openings. In one technique, a three-way valve is closed to close a discharge passage, and then a pump is driven to apply a pressure to the ink in head passages for a predetermined length of time to discharge the ink from the ejection openings and thereby clean the ejection openings.

SUMMARY

In the above-described technique, however, the air bubbles and the high-viscosity ink discharged may be attached to the ejection openings in the ejection opening cleaning. In this case, a cleaning member such as a wiper can be used to remove the air bubbles and the high-viscosity ink. However, in a case where a negative pressure is applied to the ink in the head by a head difference, for example, a negative pressure is applied to the ink near the ejection openings after a completion of the ejection opening cleaning. As a result, the ink near the ejection openings may flow from the ejection openings into the head with the air bubbles and the high-viscosity ink, leading to ejection failure.

This invention has been developed to provide a liquid ejection apparatus configured to prevent liquid near ejection openings from being sucked into the ejection openings with foreign matters after an ejection-opening purging operation.

The present invention provides a liquid ejection apparatus including: a liquid ejection head including (a) an inlet opening through which liquid flows into the liquid ejection head, (b) an outlet opening through which the liquid flows out of the liquid ejection head; an internal passage through which the inlet opening and the outlet opening communicate with each other, (c) an ejection surface formed with a plurality of ejection openings through which the liquid ejection head ejects the liquid, and (d) a plurality of individual liquid passages extending from the internal passage respectively to the plurality of ejection openings; a first tank configured to store the liquid to be supplied to the liquid ejection head; a first supply passage through which the first tank and the inlet opening communicate with each other; a first discharge passage through which the outlet opening and the first tank communicate with each other; a first pump configured to supply the liquid from the first tank to the internal passage via the first supply passage; a communication control valve configured to switch a state of the first discharge passage selectively to one of a communicating state in which the first tank and the outlet opening communicate with each other, and an isolating state in which the first tank and the outlet opening are isolated from each other; a cap mechanism including: a facing member which faces the ejection surface, with an ejection space formed between the facing member and the ejection surface; and an elastic member which substantially isolates the ejection space from an outside space by enclosing the ejection space and the plurality of ejection openings with the facing member and the ejection surface, the cap mechanism being configured to switch a state of the ejection space selectively to one of: a first isolated state in which the ejection space is isolated from the outside space by the elastic member; a second isolated state in which the ejection space is isolated from the outside space by the elastic member in a state in which the facing member is spaced apart from the ejection surface by a greater distance than in the first isolated state; and an open state in which the ejection space is opened to the outside space by the elastic member; and a controller configured to control the cap mechanism, the first pump, and the communication control valve to: perform an ejection-opening purging operation for, after establishing the first isolated state of the ejection space, discharging the liquid from the plurality of ejection openings by establishing the isolating state of the first discharge passage in a state in which the liquid in the first tank is being supplied to the internal passage by the first pump; and after a completion of the ejection-opening purging operation, stop the liquid in the first tank from being supplied to the internal passage. The controller is configured to control the cap mechanism in the ejection-opening purging operation to switch the state of the ejection space from the first isolated state to the second isolated state.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIG. 7A illustrates a situation in which the lip member is located at a first contact position, and FIG. 7B illustrates a situation in which the lip member is located at a second contact position;

DETAILED DESCRIPTION OF THE EMBODIMENT

Figure 1:
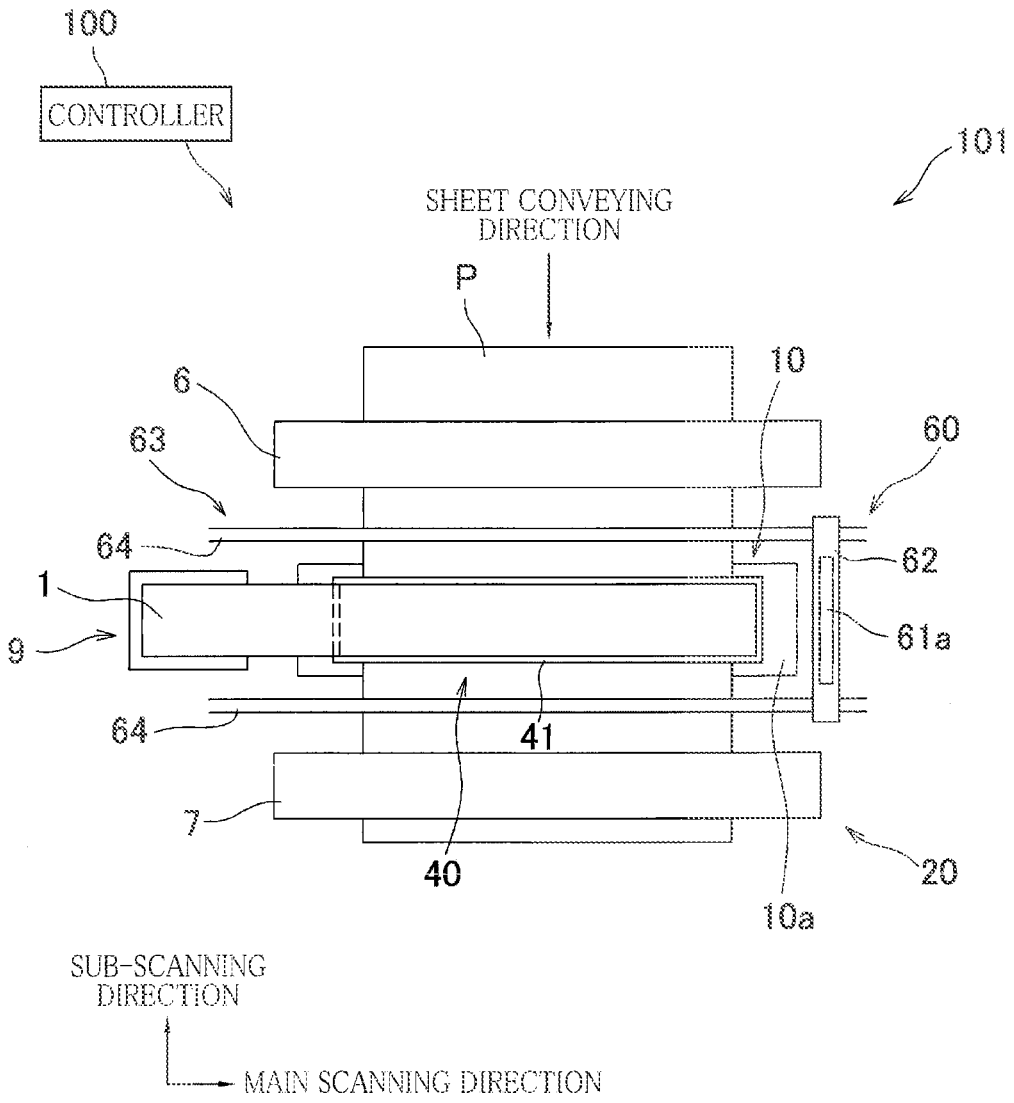
FIG. 1 is a plan view generally illustrating an ink-jet printer according to one embodiment of the present invention.

Hereinafter, there will be described one embodiment of the present invention by reference to the drawings.

There will be initially explained the overall construction of an ink-jet printer 101 as one example of a liquid ejection apparatus according to one embodiment of the present invention.

The printer 101 includes a sheet-supply portion for storing and supplying a sheet P, a conveyor portion for conveying the sheet P, an image recording portion for recording an image on the sheet P, and a sheet-output portion for receiving the sheet P after image recording. These portions are arranged along a sheet conveyance path. The conveyor portion is constituted mainly by a conveyor unit 20. The image recording portion includes a head 1, an ink supply unit 9, a platen 10, a platen elevating and lowering mechanism 30 (see FIG. 9), a cap mechanism 40, a head elevating and lowering mechanism 70 (see FIG. 9), a wiper unit 60 (see FIG. 12), a humidifying mechanism 50 (see FIG. 5), and a controller 100. In image recording, the head 1 ejects ink onto the sheet P conveyed by the conveyor unit 20.

As illustrated in FIG. 1, the conveyor unit 20 includes two conveyor roller pairs 6, 7. Each of the conveyor roller pairs 6, 7 is constituted by two rollers capable of rotating while nipping the sheet P in its thickness direction. One of the two rollers of each of the conveyor roller pairs 6, 7 is a drive roller which is rotated by driving of a corresponding one of conveyance motors 6M, 7M (see FIG. 9) under control of the controller 100. The other roller is a driven roller which is rotated by the rotation of the drive roller. These conveyor roller pairs 6, 7 convey the sheet P from an upper side to a lower side in FIG. 1. In the present embodiment, a sub-scanning direction is a direction parallel to a sheet conveying direction in which the sheet P is conveyed by the conveyor unit 20, and a main scanning direction is a direction perpendicular to the sub-scanning direction and parallel to a horizontal plane.

The head 1 is a line head extending in the main scanning direction and configured to eject black ink droplets onto the sheet P. The head 1 is supported by a head holder 3 (see FIG. 6). A lower surface of the head 1 is an ejection surface 2*a* (see FIG. 4) having a multiplicity of ejection openings 108 formed therein. In addition to the head 1, a cap 41 of the cap mechanism 40 is mounted on the head holder 3. This cap 41 is provided on the head 1 so as to enclose the head 1 in plan view. The cap mechanism 40 will be explained later in detail.

The ink supply unit 9 is connected to a left end portion of the lower surface of the head 1 in FIG. 1. The ink supply unit 9 supplies ink to the head 1 connected thereto.

The head elevating and lowering mechanism 70 elevates and lowers the head holder 3 and a portion of the cap mechanism 40 (except the platen 10 and the platen elevating and lowering mechanism 30) to move the head 1 between a recording position and an upper position. At the recording position, the head 1 is located at a lowermost end of a head moving area (see FIG. 5) and opposed to the platen 10 at a distance appropriate for image recording. At the upper position (see FIG. 12C), the head 1 is located at an uppermost end of the head moving area and spaced apart from the platen 10 at a relatively large distance. A wiping position (see FIG. 12B) is located between the recording position and the upper position. At the wiping position and the upper position, wipers 61*a*, 61*b* which will be described below are movable in a space formed between the head 1 and the platen 10.

Figure 12A:
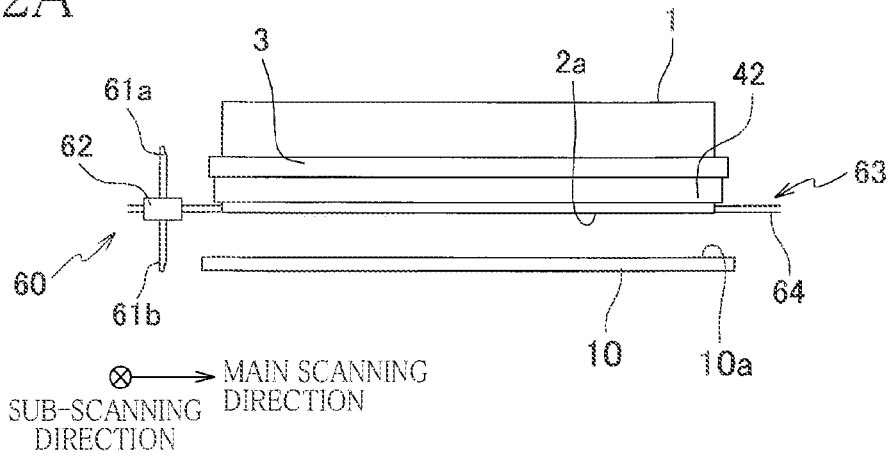
FIGS. 12A-12C are views for explaining a wiping operation.

As illustrated in FIGS. 1 and 12, the wiper unit 60 wipes the ejection surface 2*a* and an upper surface 10*a* of the platen 10 in the main scanning direction. The wiper unit 60 includes: the two wipers 61*a*, 61*b*; a base portion 62 for supporting these wipers 61*a*, 61*b*; and a wiper moving mechanism 63 as one example of a moving mechanism. The wiper 61*a* is longer than the ejection surface 2*a* in the sub-scanning direction and provided upright on an upper surface of the base portion 62 to wipe the ejection surface 2*a*. The wiper 61*b* is longer than the upper surface 10*a* in the sub-scanning direction and provided upright on a lower surface of the base portion 62 to wipe the upper surface 10*a*. The wiper moving mechanism 63 is constituted by a pair of guides 64 and a drive motor 60M (see FIG. 9). When the drive motor 60M is driven under control of the controller 100, the base portion 62 is reciprocated along the guides 64. As illustrated in FIG. 12A, a position located on a left side of a left end portion of the head 1 is a wait position of the base portion 62 (in FIG. 1, the wait position is located on a right side of a right end portion of the head 1). In a wiping operation, the wipers 61*a*, 61*b* move rightward in FIG. 12 to wipe the ejection surface 2*a* and the upper surface 10*a* of the platen 10. The base portion 62 returns to the wait position after the head 1 and the platen 10 are moved to the upper position and a fourth position, respectively.

The humidifying mechanism 50 supplies humid air into an ejection space S1 formed under and opposite the ejection surface 2*a*. Ink in the ejection openings 108 opening in the ejection space S1 is replenished with water, thereby reducing an amount of increase in viscosity of the ink and a degree of drying of the ink.

The platen 10 is shaped like a planar plate and opposed to the head 1 in the vertical direction that is perpendicular to the main scanning direction and the sub-scanning direction. A predetermined space appropriate for image recording is formed between the upper surface 10*a* of the platen 10 and the ejection surface 2*a*. The platen 10 is one size larger in plan view than each of the ejection surface 2*a* and the cap 41.

Figure 8A:
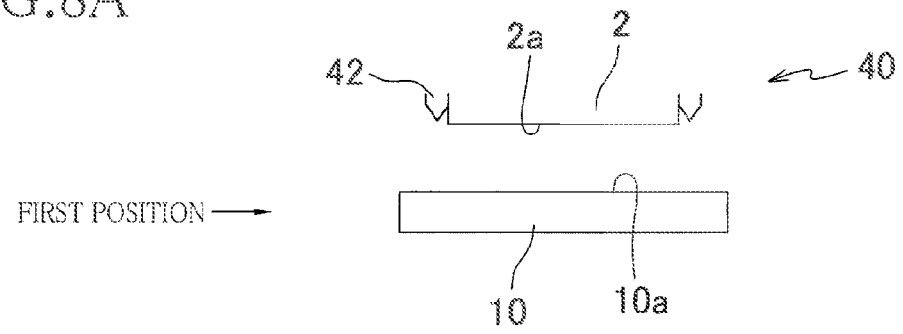
FIGS. 8A-8C are views for explaining operations of the cap mechanism and a platen.
Figure 8B:
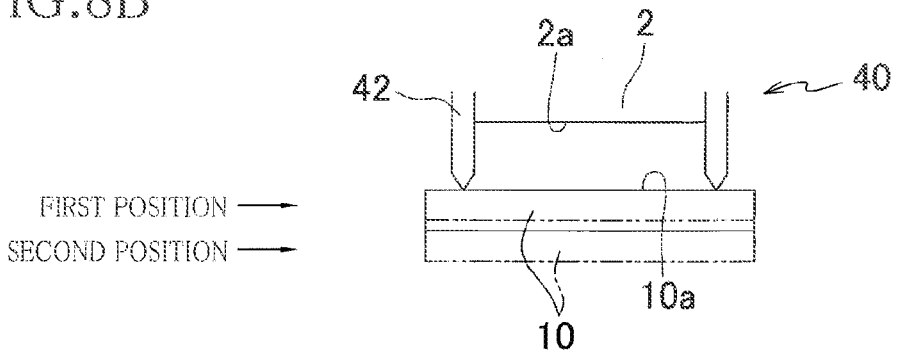
Figure 8C:
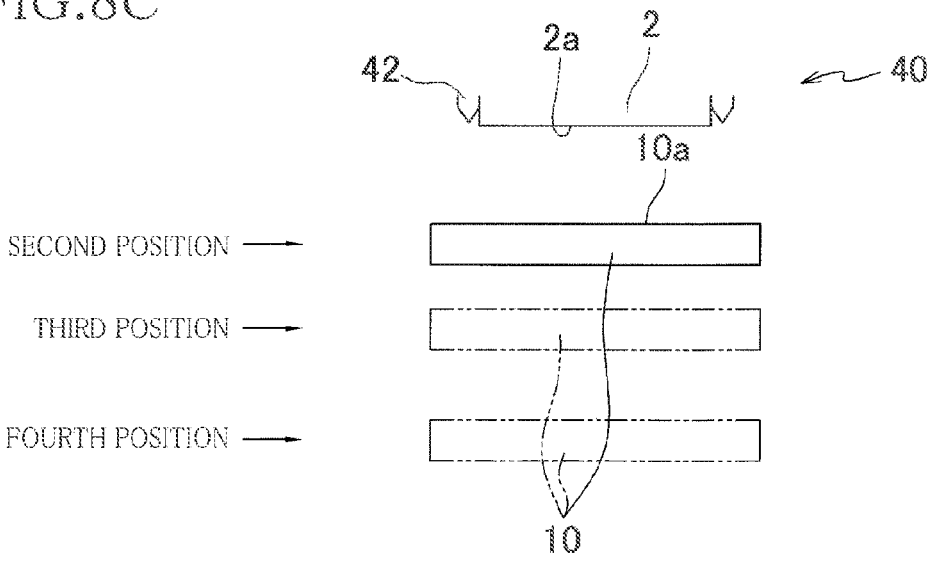

The platen elevating and lowering mechanism 30 elevates and lowers the platen 10, so that the platen 10 is moved between a first position and the fourth position. As illustrated in FIG. 8A, the first position is a position at which the platen 10 is nearest to the ejection surface 2*a*, and the platen 10 is positioned at this first position in image recording. Also, as illustrated in FIG. 8B, the first position corresponds to a first contact position of a lip member 42 which will be described below and relates to a capping operation. As illustrated in FIGS. 8B and 8C, a second position is a position of the platen 10 at which a distance between the upper surface 10*a* and the ejection surface 2*a* is greater than that at the first position, and this second position corresponds to a second contact position of the lip member 42. As illustrated in FIG. 8C, a third position is a position at which the distance between the upper surface 10*a* and the ejection surface 2*a* is greater than that at the second position, and this third position relates to the wiping operation of the wiper 61*b*. As illustrated in FIG. 8C, the fourth position is a position at which the distance between the upper surface 10*a* and the ejection surface 2*a* is greater than that at the third position, and this fourth position relates to the return of the base portion 62 to the wait position. It is noted that the third position and the fourth position are indicated by two-dot chain lines in FIG. 8C.

There will be next explained the controller 100. The controller 100 controls components and devices of the printer 101 to control the printer 101. For example, the controller 100 controls an image recording operation based on a recording command (with, e.g., image data) supplied from an external device 97 such as a PC connected to the printer 101. Upon receiving the recording command, the controller 100 drives the conveyance motors 6M, 7M for the respective conveyor roller pairs 6, 7. The sheet P supplied from the sheet-supply portion, not shown, is conveyed in the sub-scanning direction or the sheet conveying direction while being nipped by the conveyor roller pairs 6, 7. When the sheet P passes through a position just under the head 1 while supported on the upper surface 10*a* of the platen 10, the controller 100 controls the head 1 to eject the ink from the ejection openings 108 (see FIG. 4) onto the sheet P. The sheet P with an image recorded thereon is discharged to the sheet-output portion, not shown.

The controller 100 executes a maintenance operation to recover or maintain ink ejection characteristics of the head 1. Examples of the maintenance operation include a purging operation, a flushing operation, the wiping operation for the ejection surface 2*a* and/or the upper surface 10*a* of the platen 10, the capping operation, and a humidifying operation.

The purging operation includes an air-bubble purging operation and an ejection-opening purging operation, and devices such as a purging pump 86 which will be described below are driven in the purging operation. In the air-bubble purging operation as one example of a liquid transfer operation, air bubbles and foreign matters are discharged from internal passages formed in a reservoir unit 71 which will be described below. In the ejection-opening purging operation, the ink is forcibly discharged from all the ejection openings 108. In the flushing operation, actuators are driven to eject the ink from all the ejection openings 108. The ink is ejected based on flushing data that differs from the image data. In the wiping operation, the wipers 61*a*, 61*b* wipe the ejection surface 2*a* and the upper surface 10*a* of the platen 10, respectively (see FIG. 12B). The wiping operation is performed after the ejection-opening purging operation, and residual ink and foreign matters are removed from the ejection surface 2*a*. As a result, the ejection surface 2*a* is cleaned, and the ink ejection characteristics of the ejection openings 108 are recovered. It is noted that the wiping operation for wiping the upper surface 10*a* is performed also after the flushing operation.

Figure 5:
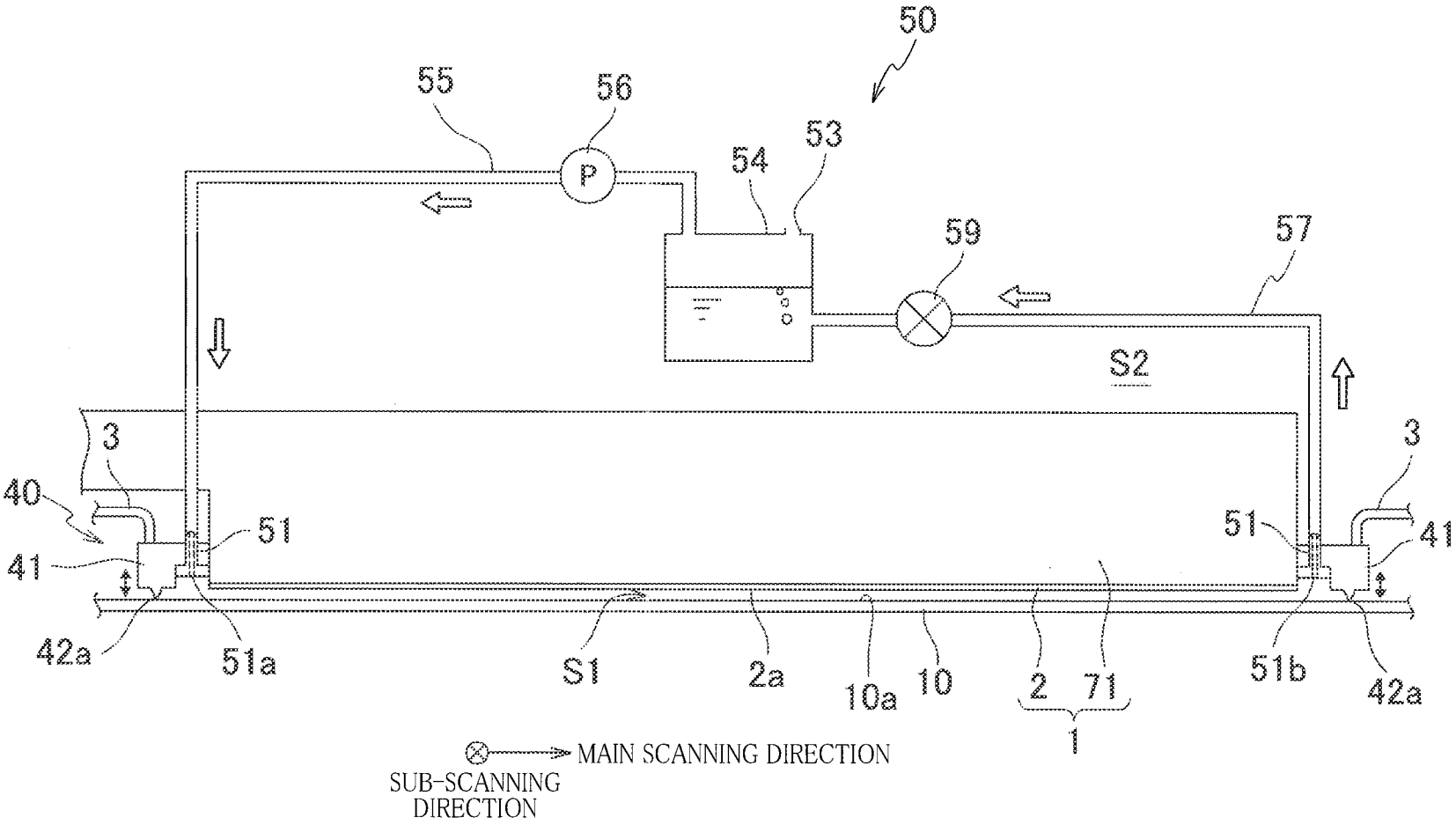
FIG. 5 is a schematic view illustrating the head, a head holder, and a humidifying mechanism contained in the printer in FIG. 1.

In the capping operation, as illustrated in FIG. 5, the ejection space S1 (i.e., the space between the ejection surface 2*a* and the platen 10) is substantially isolated from an outside space S2 by the cap 41. It is noted that this state may be referred to as "isolated state". This capping reduces a degree of the drying of meniscuses of the ink. It is noted that the capping operation is performed when each of the purging operation and the humidifying operation is performed in the present embodiment.

In the humidifying operation, as illustrated in FIG. 5, humid air is supplied into the ejection space S1 being in the isolated state. As a result, water vapors remain in the ejection space S1, resulting in further reduction of the degree of drying of the ink.

Figure 2:
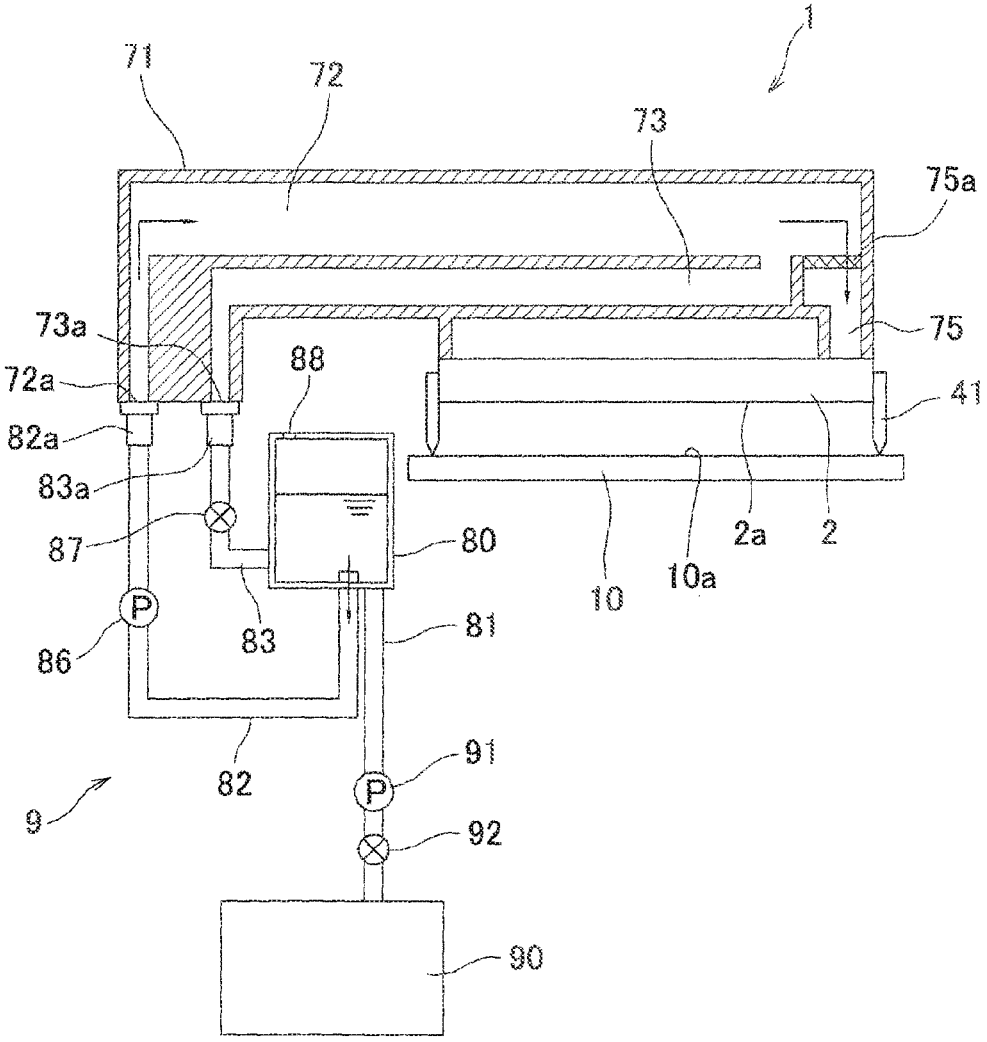
FIG. 2 is a cross-sectional view of a head and an ink supply unit illustrated in FIG. 1 for explaining a situation of an ejection-opening purging operation.

There will be next explained the head 1 in detail with reference to FIG. 2. As illustrated in FIG. 2, the head 1 includes the reservoir unit 71 and a head main body 2.

The reservoir unit 71 is a passage defining member having a generally rectangular parallelepiped shape and fixed to an upper surface of the head main body 2. The reservoir unit 71 supplies the ink to the head main body 2. An inlet opening 72*a* and an outlet opening 73*a* are formed in a lower surface of the reservoir unit 71, and internal passages are formed in the reservoir unit 71. The internal passages are constituted by an ink inlet passage 72 and an air discharge passage 73. Ten ink outlet passages 75 are connected to the internal passages. The inlet opening 72*a* is one end of the ink inlet passage 72, and the outlet opening 73*a* is one end of the air discharge passage 73. In the reservoir unit 71, the ink inlet passage 72 is connected to the air discharge passage 73, and the ink outlet passages 75 are branched off from a portion of the ink inlet passage 72 which is near a position at which the ink inlet passage 72 is connected to the air discharge passage 73. The ink outlet passages 75 communicate with the head main body 2. It is noted that FIG. 2 illustrates only one of the ink outlet passages 75.

The ink from the ink supply unit 9 is supplied to the ink inlet passage 72 via the inlet opening 72*a*. The ink inlet passage 72 serves as an ink reservoir for temporarily storing ink. Each of the ink outlet passages 75 communicates at one end with the ink inlet passage 72 via a filter 75*a* and is connected at the other end to ink supply openings 105*b* (see FIG. 3) formed in an upper surface of a passage unit 11. In normal printing, the ink from the ink supply unit 9 is transferred through the ink outlet passages 75 and supplied from the ink supply openings 105*b* to the passage unit 11.

The air discharge passage 73 is connected to the ink inlet passage 72 at a position located upstream of the filter 75*a* and to the ink supply unit 9 via the outlet opening 73*a*. When the ink flows into the air discharge passage 73, the ink flows into the air discharge passage 73 while flowing over an upstream-side surface of the filter 75*a*. In the air-bubble purging operation of the maintenance operation which will be described below, the ink from the ink supply unit 9 flows into the ink inlet passage 72 via the inlet opening 72*a* and returns to the ink supply unit 9 from the outlet opening 73*a* via the air discharge passage 73.

Figure 3:
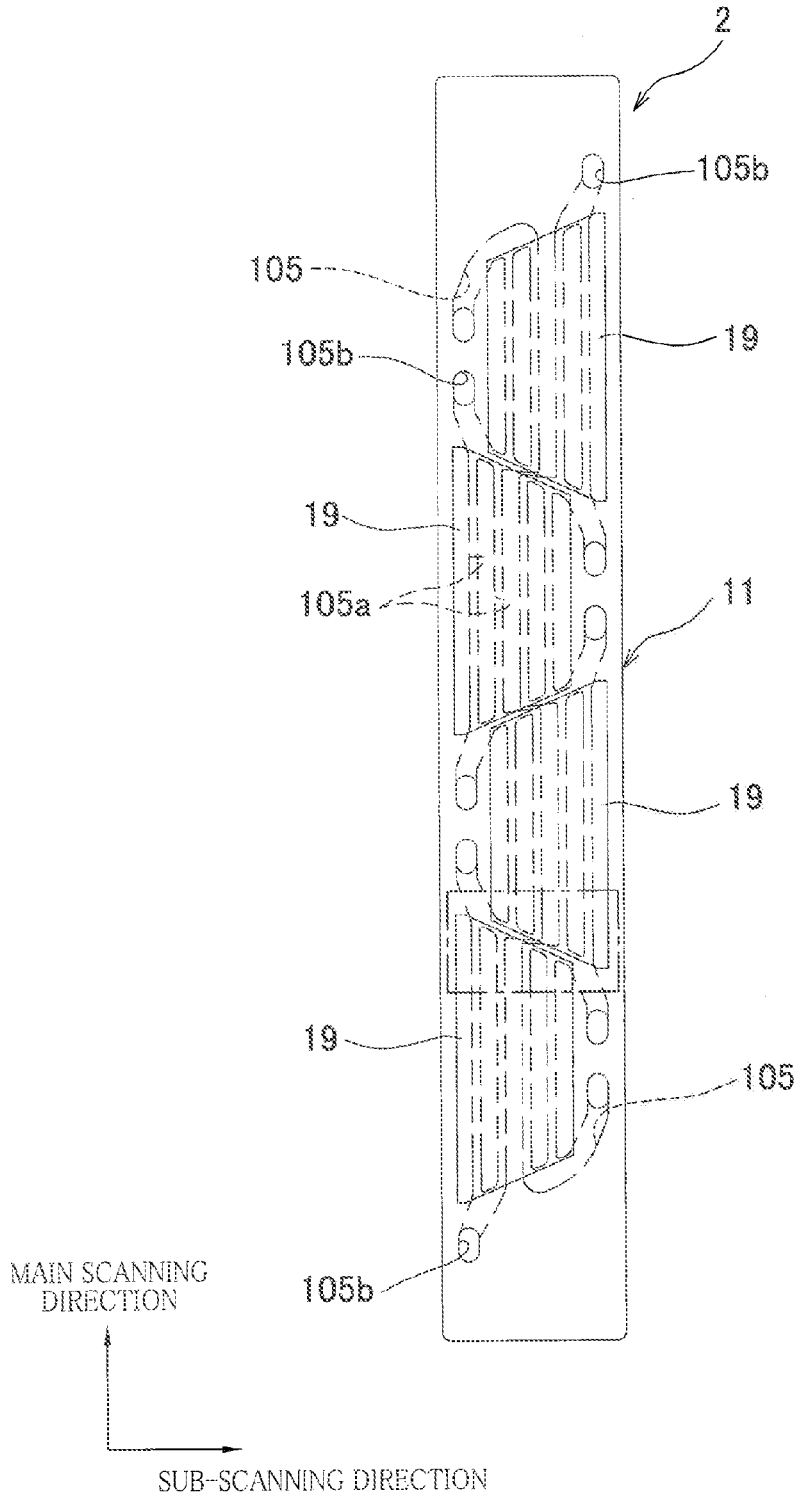
FIG. 3 is a plan view illustrating a head main body illustrated in FIG. 2.
Figure 4A:
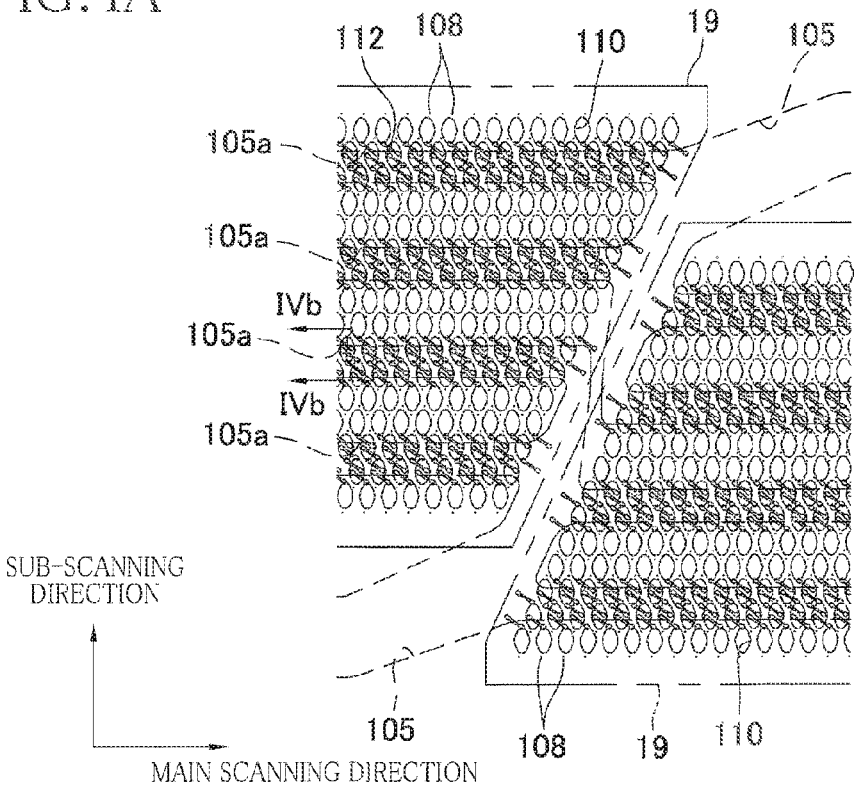
FIG. 4A is an enlarged view illustrating an area enclosed by one-dot chain line in FIG. 3.
Figure 4B:
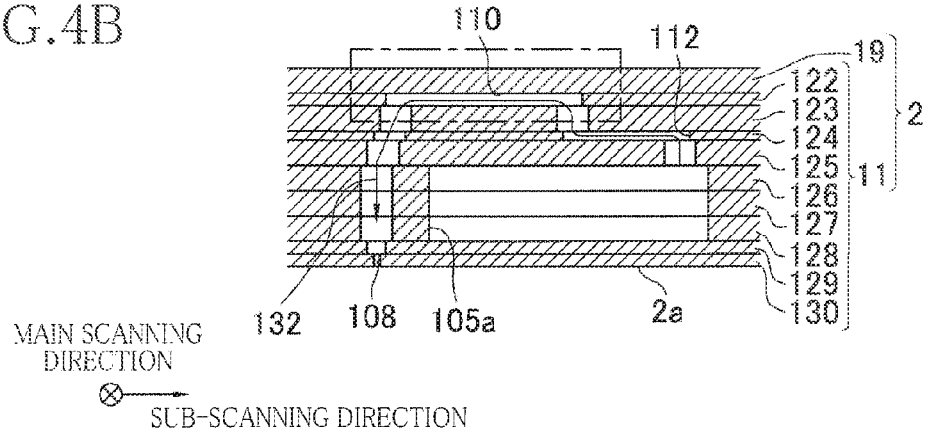
FIG. 4B is a partial cross-sectional view taken along line IVb-IVb in FIG. 4A.
Figure 4C:
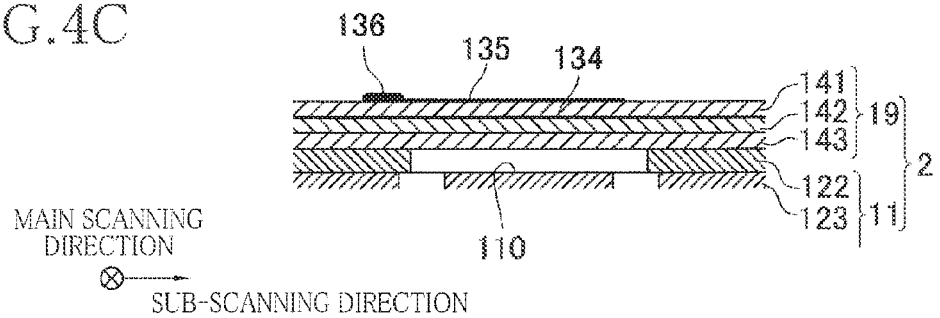
FIG. 4C is an enlarged view illustrating an area enclosed by one-dot chain line in FIG. 4B.

There will be next explained the head main body 2 with reference to FIGS. 3 and 4A-4C. In FIG. 4A, pressure chambers 110, apertures 112, and the ejection openings 108 are illustrated by solid lines for easier understanding though these elements are located under actuator units 19 and thus should be illustrated by broken lines.

The head main body 2 includes the passage unit 11 and the four actuator units 19 fixed to an upper surface of the passage unit 11. The passage unit 11 has ink passages including the pressure chambers 110. The actuator units 19 are connected to the controller 100 via a flexible printed circuit (FPC). Signals produced by the controller 100 are converted to drive signals by a driver IC 19*a* on the FPC and output to the actuator units 19. Each of the actuator units 19 includes a multiplicity of unimorph actuators corresponding to the respective pressure chambers 110. When the drive signal is supplied, the actuator applies ejection energy to the ink in the corresponding pressure chamber 110.

The passage unit 11 is constituted by nine stainless metal plates 122-130 stacked on one another. Formed in the upper surface of the passage unit 11 are the ten ink supply openings 105*b* communicating with the respective ink outlet passages 75 formed in the reservoir unit 71 (see FIG. 2). As illustrated in FIGS. 3 and 4A, the passage unit 11 has: manifold passages 105 whose one ends are the ink supply openings 105*b*; and sub-manifold passages 105*a* each branched off from a corresponding one of the manifold passages 105. The passage unit 11 further has individual ink passages 132 each extending from an outlet of a corresponding one of the sub-manifold passages 105*a* to a corresponding one of the ejection openings 108 of the ejection surface 2*a* via a corresponding one of the pressure chambers 110. The ejection openings 108 are open in the ejection surface 2*a* so as to be arranged in matrix.

There will be next explained a flow of the ink in the passage unit 11. In normal printing, as illustrated in FIGS. 3, 4A, and 4B, the ink supplied from the ink outlet passages 75 of the reservoir unit 71 to the ink supply openings 105*b* flows into the manifold passages 105 (and the sub-manifold passages 105*a*). The ink in the sub-manifold passages 105*a* are distributed to the individual ink passages 132 and flows to the ejection openings 108 via apertures 112 and the pressure chambers 110, respectively. It is noted that the passage resistance of each of ink flow passages as one example of individual liquid passages respectively extending from outlets of the internal passages (i.e., portions of the internal passages which are connected to the ink outlet passages 75) to the ejection openings 108 is higher than that of each of the internal passages, i.e., the ink inlet passage 72 and the air discharge passage 73. In the air-bubble purging operation, accordingly, the ink from the ink supply unit 9 flows from the ink inlet passage 72 into the air discharge passage 73 while flowing over the upstream-side surface of the filter 75*a* and returns to the ink supply unit 9.

There will be next explained the ink supply unit 9 in detail with reference to FIG. 2. The ink supply unit 9 includes a sub-tank 80 as one example of a first tank, a supply pump 91, a valve 92, an ink supply tube 81, the purging pump 86 as one example of a first pump, an ink supply tube 82 as one example of a first supply passage, a valve 87 as one example of a liquid cut-off valve, and an ink returning tube 83 as one example of a first discharge passage. In the ink supply unit 9, the ink supply tube 81, the ink supply tube 82, and the ink returning tube 83 are connected to the sub-tank 80. The supply pump 91 and the valve 92 are provided on the ink supply tube 81. The ink supply tube 81 connects between an ink tank 90 and the sub-tank 80. The purging pump 86 is provided on the ink supply tube 82. The ink supply tube 82 connects between the sub-tank 80 and the inlet opening 72*a*. The valve 87 is provided on the ink returning tube 83. The ink returning tube 83 connects between the sub-tank 80 and the outlet opening 73*a* (noted that the ink returning tube 83 is connected to the outlet opening 73*a* via a joint 83*a*). The valve 87 is an open/close valve capable of cutting off a flow of the ink in the ink returning tube 83.

The sub-tank 80 stores ink to be supplied to the head 1. When an amount of ink stored in the sub-tank 80 becomes small, the valve 92 is opened and the supply pump 91 is driven to supply new ink from the ink tank 90. An upper wall of the sub-tank 80 has an air communicating hole 88 establishing communication between the inside of the sub-tank 80 and ambient air. As a result, a pressure of air in the sub-tank 80 is always kept at an atmospheric pressure regardless of an amount of ink stored in the sub-tank 80, enabling stable ink supply.

As illustrated in FIG. 2, the sub-tank 80 is disposed such that a liquid surface, a liquid level, of the ink stored therein is located below the ejection surface 2*a* in the vertical direction. As a result, a head difference occurs between the ink meniscuses formed near the ejection openings 108 and the liquid surface, i.e., the liquid level, of the ink stored in the sub-tank 80, so that a negative pressure that is lower than the atmospheric pressure is generated on an ink side of the ink meniscuses on which the ink exists (in other words, on a side of the ink meniscuses which is located nearer to the liquid surface). This negative pressure is adjusted to have such a magnitude that does not break the ink meniscuses. The sub-tank 80 and the ejection openings 108 of the head 1 always communicate with each other.

The ink supply tube 82 is connected to the inlet opening 72*a* of the reservoir unit 71 via a joint 82*a*, so that the ink stored in the sub-tank 80 is supplied into the ink inlet passage 72 of the reservoir unit 71. The purging pump 86 forcibly supplies the ink stored in the sub-tank 80, into the ink inlet passage 72. It is noted that even when the purging pump 86 is being stopped, the ink stored in the sub-tank 80 can be supplied into the reservoir unit 71 through the ink supply tube 82. As a result, the sub-tank 80 and the ejection openings 108 of the head 1 always communicate with each other. The purging pump 86 is configured to discharge ink with the same power in the air-bubble purging operation and the ejection-opening purging operation, that is, the purging pump 86 is configured such that the same amount of ink is discharged per unit time in the air-bubble purging operation and the ejection-opening purging operation. As a modification, this purging pump 86 may be replaced with a purging pump capable of changing an amount of ink to be discharged per unit time.

In the present embodiment, the amount of ink to be discharged from the purging pump 86 is set such that a pressure differential between an air side pressure and an ink side pressure generated in the ink inlet passage 72 and affecting the ink meniscuses is less than or equal to a meniscus withstanding pressure in an open state of the valve 87 in which the ink is circulating. It is noted that the meniscus withstanding pressure corresponds to a maximum pressure differential which does not break the ink meniscuses.

There will be next explained the constructions of the head holder 3 and the cap mechanism 40 with reference to FIGS. 5-7B.

Figure 6:
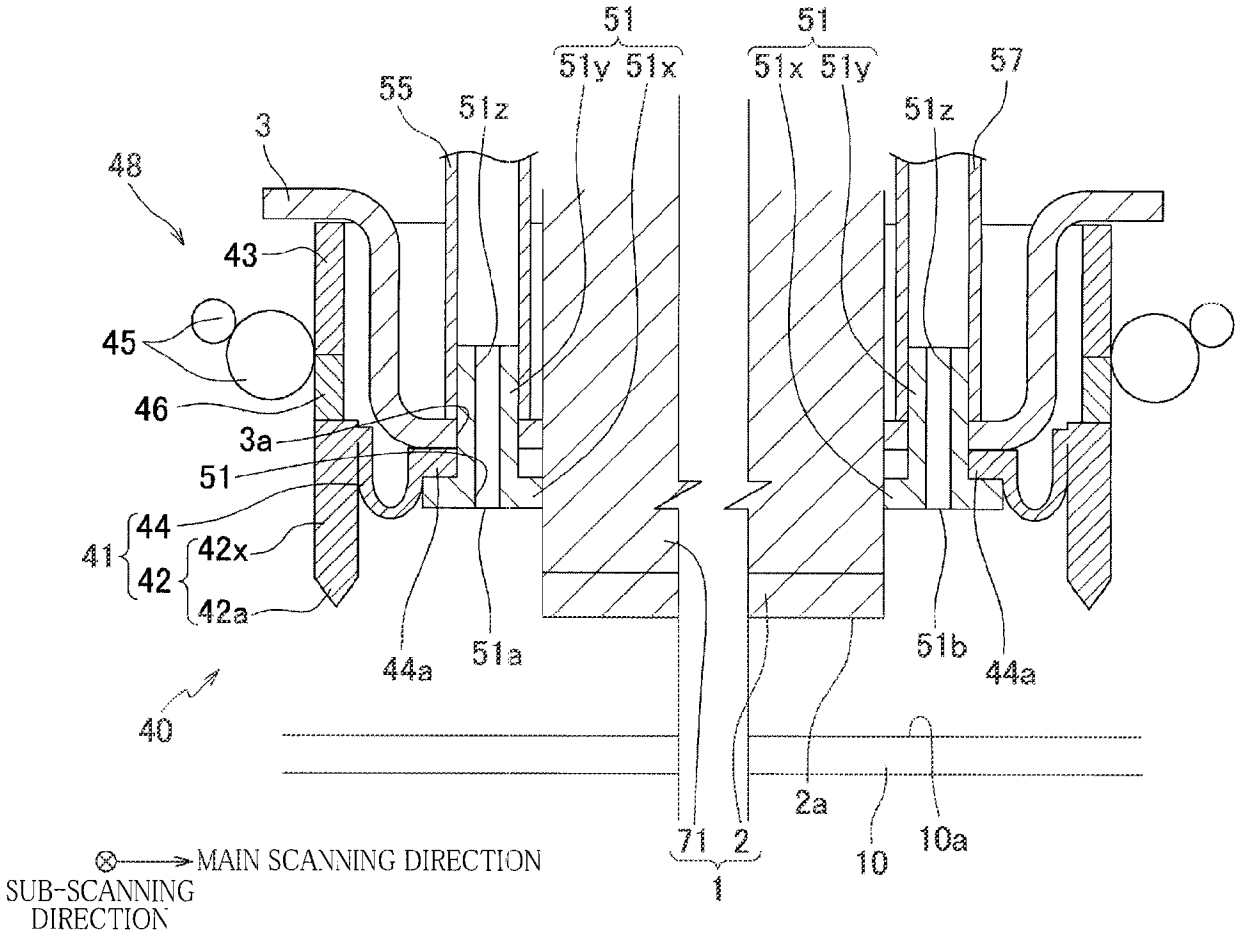
FIG. 6 is a partial cross-sectional view of a cap mechanism and the head in a sub-scanning direction, with a lip member being located at a distant position.

The head holder 3 is a frame formed of, e.g., metal and supporting side faces of the reservoir unit 71 in its entire perimeters. The cap 41 of the cap mechanism 40 and a pair of joints 51 are mounted on the head holder 3. Contact portions of the head holder 3 and the head 1 are sealed by a sealant in their entire perimeters. Contact portions of the head holder 3 and the cap 41 are also fixed to each other in their entire perimeters with adhesives. As illustrated in FIG. 6, the head holder 3 has two through holes 3*a* in which the pair of joints 51 are fitted. Clearances between the through holes 3*a* and the joints 51 are also filled with sealants. Accordingly, when the cap 41 substantially isolates the ejection space S1 from the outside space S2, a passage through which water flows out of the space S1 is reliably shut off.

As illustrated in FIG. 5, the pair of joints 51 are respectively arranged near end portions of the head 1 in the main scanning direction. Specifically, as illustrated in FIG. 5, the pair of joints 51 are constituted by a left joint 51 having a supply opening 51*a* and a right joint 51 having an output opening 51*b*, and the reservoir unit 71 is interposed between the pair of joints 51 in the main scanning direction. In the humidifying operation, humid air is supplied from the supply opening 51*a* into the ejection space S1, and air is discharged from the output opening 51*b*. As illustrated in FIG. 5, the supply opening 51*a* and the output opening 51*b* are formed at positions farther from the upper surface 10*a* of the platen 10 than the ejection surface 2*a* in a direction directed from the upper surface 10*a* toward the reservoir unit 71.

As illustrated in FIG. 6, each of the joints 51 includes a square basal end portion 51*x* and a circular cylindrical distal end portion 51*y* extending from the basal end portion 51*x*. The size of the basal end portion 51*x* is larger in outer shape than that of the distal end portion 51*y*. A circular cylindrical hollow space 51*z* is formed in each joint 51 so as to extend in the vertical direction from the basal end portion 51*x* to the distal end portion 51*y*. The hollow space 51*z* has a fixed size in cross section along the vertical direction. A longitudinal direction of the basal end portion 51*x* coincides with the sub-scanning direction, and the length of the basal end portion 51*x* in the longitudinal direction is generally equal to that of the ejection surface 2*a*.

Figure 7A:
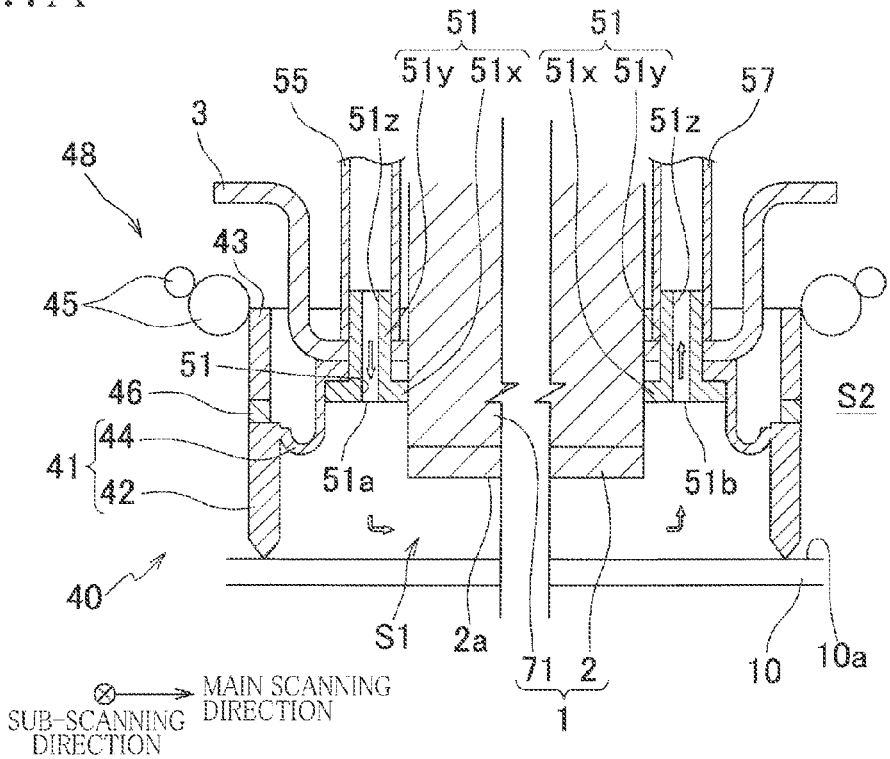
FIGS. 7A and 7B are partial cross-sectional views of the cap mechanism and the head in the sub-scanning direction.
Figure 7B:
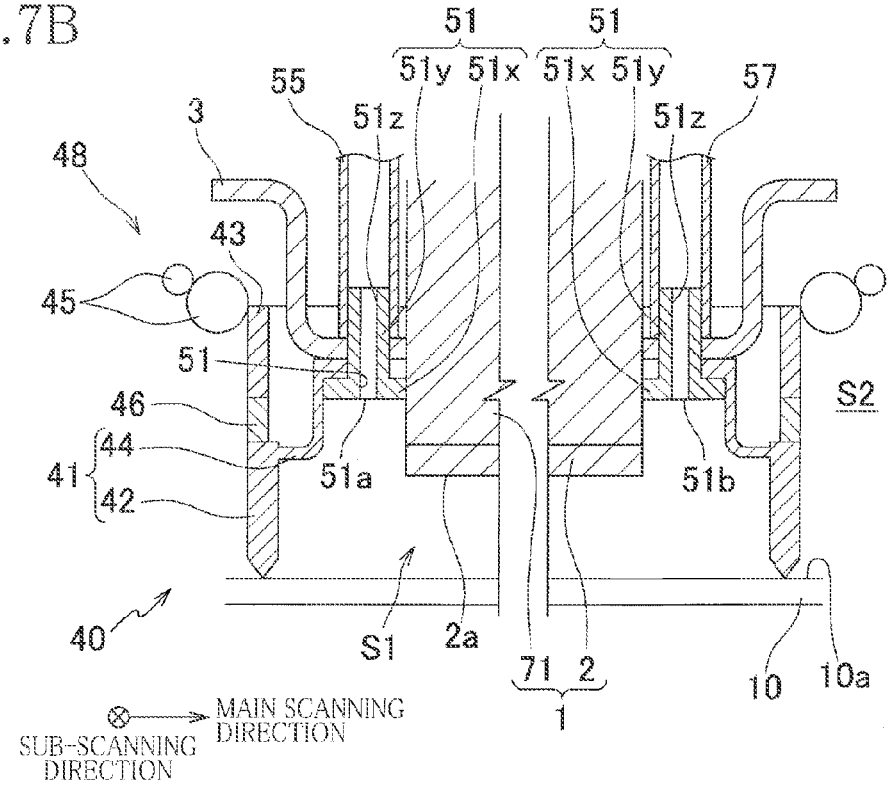

The cap mechanism 40 includes the cap 41, a cap elevating and lowering mechanism 48 for elevating and lowering the cap 41, the platen 10, and the platen elevating and lowering mechanism 30. The cap 41 can enclose the ejection space S1 with the head 1 and is elongated in the main scanning direction. As illustrated in FIGS. 6, 7A, and 7B, the cap 41 includes the lip member 42 and a diaphragm 44.

The lip member 42 is formed of elastic material such as rubber and encloses the head 1 in plan view. As illustrated in FIG. 6, the lip member 42 includes a base portion 42*x* and a projecting portion 42*a* having a triangle shape in cross section and located under the base portion 42*x*. An urging portion 46 which will be described below is fixed to an upper surface of the base portion 42*x*.

The diaphragm 44 is also formed of elastic material such as rubber and encloses the head 1 in plan view. More specifically, the diaphragm 44 is a flexible thin-film member whose one end (i.e., outer circumferential end) is connected to an inner circumferential surface of the lip member 42. The lip member 42 is integral with the diaphragm 44. An inner circumferential end of the diaphragm 44 is a close contact portion 44*a*. An upper surface of the close contact portion 44*a* is fixed in its entire perimeter to the head holder 3 with adhesives. A lower surface of the close contact portion 44*a* is partly fixed to an upper surface of the basal end portion 51*x* of the joint 51.

Figure 9:
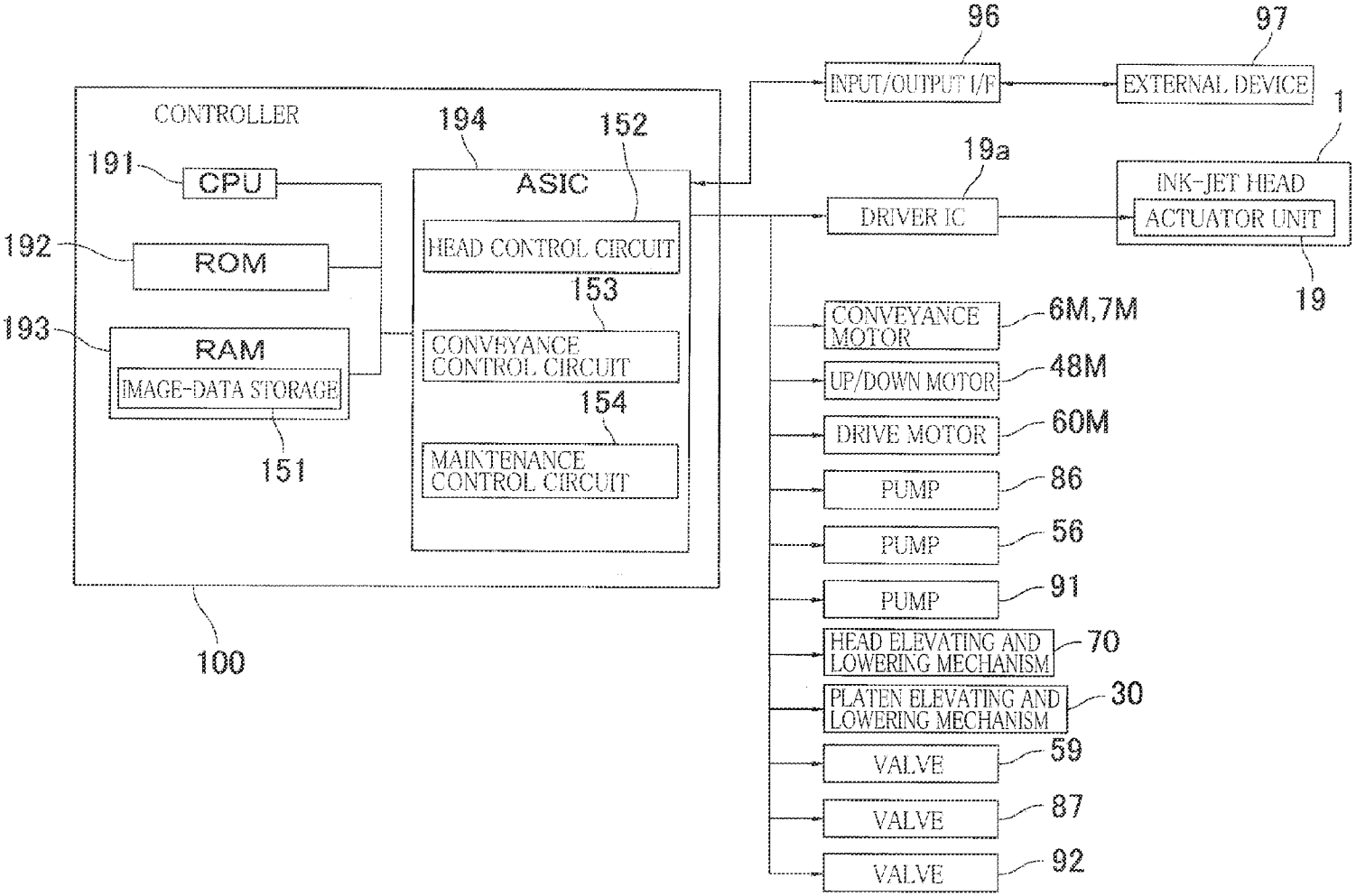
FIG. 9 is a block diagram illustrating an electric configuration of the printer.

The cap elevating and lowering mechanism 48 as one example of a lip moving mechanism includes a movable member 43, the urging portion 46, a plurality of gears 45, and an up/down motor 48M (see FIG. 9). As illustrated in FIG. 6, the movable member 43 is connected to the plurality of gears 45. The urging portion 46 is an elastic member which can extend and contract in the vertical direction and is connected to a lower end of the movable member 43 and to an upper end of the lip member 42. When the up/down motor 48M is driven under control of the controller 100, the gears 45 are rotated to elevate and lower the movable member 43, the urging portion 46, and the base portion 42*x*, so that a relative position between a distal end of the projecting portion 42*a* and the ejection surface 2*a* changes in the vertical direction.

With the upward and downward movement of the movable member 43 and the urging portion 46, the lip member 42 is moved selectively to one of a contact position (illustrated in FIGS. 5, 7A, and 7B) at which the distal end of the lip member 42, i.e., the projecting portion 42*a* is in contact with the upper surface 10*a* of the platen 10 and a distant position (illustrated in FIG. 6) at which the distal end of the lip member 42 is spaced apart from the upper surface 10*a*. The contact position includes the first contact position and the second contact position. As illustrated in FIG. 7A, the first contact position is a position at which the lip member 42 is contactable with the upper surface 10*a* of the platen 10 located at the first position in a state in which the urging portion 46 has contracted the most. As a result, the ejection space S1 is in a first isolated state. As illustrated in FIG. 7B, the second contact position is a position at which the lip member 42 is contactable with the upper surface 10*a* located at the second position in a state in which the urging portion 46 extends by a larger amount than in the state in which the lip member 42 is located at the first contact position. As a result, the ejection space S1 is in a second isolated state in which the ejection space S1 is larger than that in the first isolated state. While a force of the contact of the lip member 42 on the upper surface 10*a* is larger in the first isolated state (at the first contact position) than in the second isolated state (at the second contact position) by the contraction of the urging portion 46, the force is enough to establish an enclosed state of the ejection space S1 even when the lip member 42 is located at any of the first isolated state and the second isolated state. At the distant position, the projecting portion 42*a* is positioned above the ejection surface 2*a* in a state in which the urging portion 46 has extended the most, and the ejection space S1 is open to the outside space S2.

There will be next explained the construction of the humidifying mechanism 50 with reference to FIG. 5.

As illustrated in FIG. 5, the humidifying mechanism 50 includes the cap 41, the pair of joints 51, a tube 55 as one example of a second supply passage, a tube 57 as one example of a second discharge passage, a pump 56, a valve 59, and a tank 54. One end of the tube 55 is fitted in the left joint 51 in FIG. 5, and the other end is connected to the tank 54. One end of the tube 57 is fitted in the right joint 51 in FIG. 5, and the other end is connected to the tank 54. The tubes 55, 57 thus establish a communication between the ejection space S1 and the tank 54.

A lower space of the tank 54 stores water for humidification, and an upper space of the tank 54 stores air humidified by the water. An upper wall of the tank 54 has an air communicating hole 53 through which the inside of the tank 54 and ambient air communicate with each other. The tube 57 communicates with the lower space of the tank 54 (i.e., beneath a water surface). The tube 55 communicates with the upper space of the tank 54. The pump 56 is provided on the tube 55. The valve 59 is an open/close valve capable of interrupting an air flow through the tube 57. It is noted that a check valve, not shown, is attached to the tube 57 near the tank 54 to prevent the water in the tank 54 from flowing into the tube 57. When an amount of the water in the tank 54 becomes small, the tank 54 is replenished with water from a water replenishing tank, not shown.

When the controller 100 drives the pump 56, as illustrated in FIGS. 5 and 7A, the air in the tank 54 is circulated in a direction indicated by white arrows. The humid air stored in the upper space of the tank 54 is supplied from the supply opening 51*a* into the ejection space S1. When the ejection space S1 is in the isolated state in this supply, air in the ejection space S1 flows toward the output opening 51*b* while replaced with the supplied humid air. It is noted that the valve 59 is kept in its open state. Since the tube 57 communicates with the tank 54 underwater, the air in the ejection space S1 is humidified in the tank 54. The produced humid air is supplied into the ejection space S1 during driving of the pump 56. The humidifying operation is thus performed. This humidifying operation is performed when the lip member 42 is located at the first contact position.

There will be next explained the controller 100 with reference to FIG. 9. The controller 100 includes a central processing unit (CPU) 191, a read only memory (ROM) 192, a random access memory (RAM) 193, and an application specific integrated circuit (ASIC) 194. The ROM 192 stores programs to be executed by the CPU 191, various kinds of fixed data, and the like. The RAM 193 temporarily stores data such as image data required during the execution of the programs. That is, the RAM 193 includes an image-data storage 151. The ASIC 194 includes a head control circuit 152, a conveyance control circuit 153, and a maintenance control circuit 154. The ASIC 194 is connected to the external device 97 such as a personal computer via an input/output interface 96, allowing data communication therebetween.

The image-data storage 151 stores image data (and a recording command) transmitted from the external device 97. The head control circuit 152 controls the driver IC 19*a* based on the image data.

The conveyance control circuit 153 controls the conveyance motors 6M, 7M based on the image data (and the recording command) such that the sheet P is conveyed in the sheet conveying direction at a predetermined speed.

The maintenance control circuit 154 controls the up/down motor 48M, the drive motor 60M, the head elevating and lowering mechanism 70, the platen elevating and lowering mechanism 30, the valves 59, 87, 92, and the pumps 56, 86, 91 in the maintenance operation.

It is noted that the single CPU 191 executes processings for various kinds of control in the present embodiment, but the present invention is not limited to this configuration. For example, the processings may be executed by a plurality of CPUs, an ASIC, or a combination of one or more CPUs and one or more ASICs.

Figure 10:
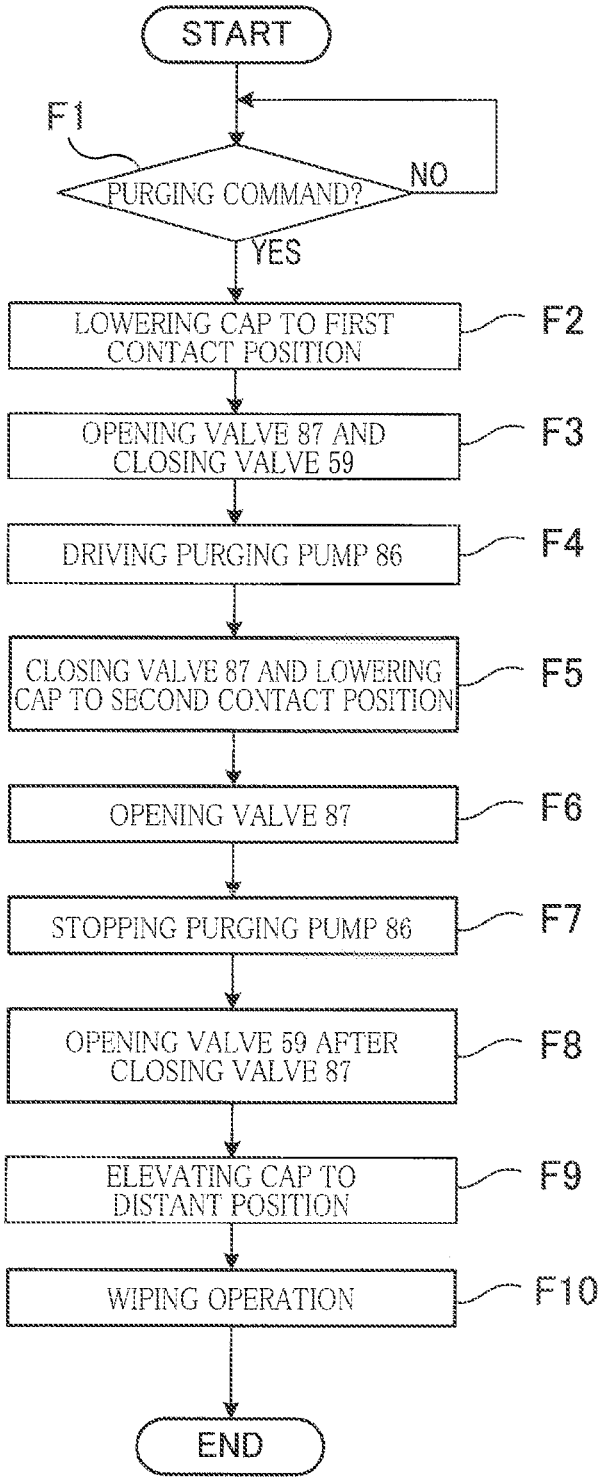
FIG. 10 is a flow chart illustrating processings of a purging operation which are executed by a controller of the printer.

There will be next explained, with reference to FIG. 10, processings for the purging operation (including the air-bubble purging operation and the ejection-opening purging operation) to be executed by the controller 100.

As illustrated in FIG. 10, this flow begins with F1 at which the controller 100 initially determines whether the controller 100 has received a purging command or not. Before a reception of the purging command, the platen 10 is located at the first position, the head 1 at the recording position, and the cap 41 at the distant position. The pump 56 and the purging pump 86 are at rest, and the valve 59 and the valve 87 are open and closed, respectively. The supply pump 91 is also at rest, and the valve 92 is closed. The conveyor unit 20 is also at rest.

Upon receiving the purging command (F1 YES), the controller 100 initially performs the capping operation. In this operation, the maintenance control circuit 154 at F2 drives the up/down motor 48M to bring the distal end of the lip member 42 into contact with the upper surface 10*a* of the platen 10, that is, the projecting portion 42*a* is moved from the distant position to the first contact position. As a result, the ejection space S1 formed between the ejection surface 2*a* and the upper surface 10*a* becomes the isolated state in which the ejection space S1 is isolated from the outside space S2 (see FIG. 7A).

Figure 11:
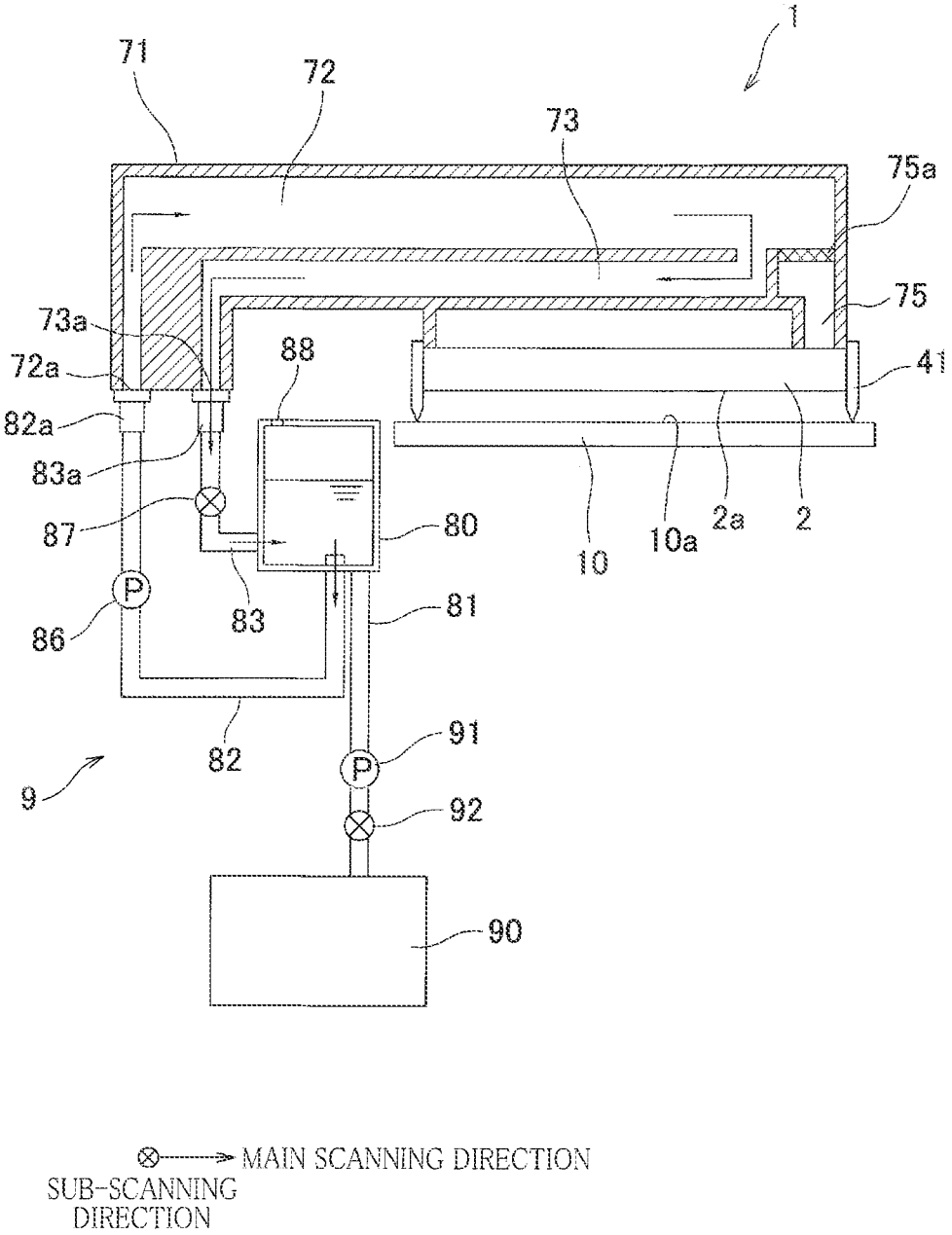
FIG. 11 is a cross-sectional view of the head and the ink supply unit illustrated in FIG. 1 for explaining a situation of an air-bubble purging operation.

After F2, the controller performs the air-bubble purging operation for circulating the ink. That is, with the ejection space S1 being in the first isolated state, the maintenance control circuit 154 changes the valve 87 from the closed state to the open state and changes the valve 59 from the open state to the closed state, thereby interrupting the air flow in the tube 57 and allowing the ink flow in the ink returning tube 83. The maintenance control circuit 154 at F4 drives the purging pump 86. As a result, as illustrated in FIG. 11, the ink stored in the sub-tank 80 is forced into the ink inlet passage 72 and circulated. In this operation, the passage resistance of the internal passages (the ink inlet passage 72 and the air discharge passage 73) is less than that of the passages extending from the ink outlet passages 75 to the ejection openings 108, and the valve 87 is in the open state. Thus, the supplied ink passes through the air discharge passage 73 and the ink returning tube 83 in order and returns to the sub-tank 80 without flowing into the ink outlet passages 75. This circulation increases a pressure of ink in a passage extending from the purging pump 86 to the sub-tank 80 in the circulation passage, but the ink meniscuses of the ejection openings 108 are maintained without broken. In this ink circulation, foreign matters such as air bubbles remaining in the ink inlet passage 72, especially, foreign matters such as air bubbles remaining on the filter 75*a* flow from the air discharge passage 73 through the ink returning tube 83 together with the ink and are caught in the sub-tank 80 (noted that this operation is the air-bubble purging operation).

In the air-bubble purging operation, as described above, the amount of ink to be supplied from the purging pump 86 is adjusted to an amount which can maintain the ink meniscuses. An amount of ink to be supplied to the ink inlet passage 72 per unit time is adjusted such that a pressure generated in the ink inlet passage 72 is higher than or equal to the negative pressure occurring due to the head difference (i.e., a height difference between the ejection surface 2*a* and the liquid surface in the sub-tank 80) and lower than or equal to the meniscus withstanding pressure. Accordingly, foreign matters such as air bubbles can be moved to the sub-tank 80 without unnecessary ink consumption.

After a lapse of a predetermined length of time from the start of the air-bubble purging operation, the ejection-opening purging operation is performed. In this operation, the purging pump 86 is kept driven as in the air-bubble purging operation. The maintenance control circuit 154 at F5 switches the valve 87 from the open state to the closed state. As a result, the ink flow through the ink returning tube 83 is interrupted, and thereby the ink flowing in the air discharge passage 73 is suddenly held, so that an ink pressure in the air discharge passage 73 and the ink inlet passage 72 rises sharply, and the pressure differential in the ink meniscuses also exceeds the meniscus withstanding pressure considerably. As a result, all the ink supplied to the ink inlet passage 72 flows into the ink outlet passages 75, passes through the manifold passages 105 and the individual ink passages 132, and is discharged from the ejection openings 108. In this operation, foreign matters and air bubbles remaining on a side of the ink outlet passages 75 nearer to the ejection openings 108 are discharged together with high-viscosity ink near the ejection openings 108. The ink discharged is received on the upper surface 10*a* of the platen 10. Also, since the ejection space S1 is defined by the cap 41 during the ejection-opening purging operation, the ink discharged does not spatter.

Just after the start of the ejection-opening purging operation (the change of the valve 87 from the open state to the closed state), the maintenance control circuit 154 at F5 controls the platen elevating and lowering mechanism 30 to move the platen 10 to the second position. With this movement of the platen 10, as illustrated in FIGS. 7B and 11, the lip member 42 is moved to the second contact position. The urging portion 46 extends from the most contracted state by an amount corresponding to the movement of the platen 10. The ejection space S1 is thus changed from the first isolated state to the second isolated state, resulting in increase in the size or volume of the ejection space S1. Thus, the pressure in the air side of the ink meniscuses (in the ejection space S1) becomes a negative pressure. This negative pressure is higher than or equal to the negative pressure occurring due to the head difference (i.e., the height difference between the ejection surface 2*a* and the liquid surface in the sub-tank 80) and less than the meniscus withstanding pressure. That is, the meniscus withstanding pressure in the second isolated state becomes smaller than that in the first isolated state. The distance between the platen 10 and the ejection surface 2*a* is thus set such that the switch of the ejection space S1 from the first isolated state to the second isolated state generates a negative pressure on the air side of the ink meniscuses, which negative pressure is higher than or equal to the negative pressure generated due to the head difference and lower than a pressure whose absolute value is equal to that of a pressure generated on the ink side of the ink meniscuses during the ejection-opening purging operation and whose polarity is reverse to that of the pressure generated on the ink side of the ink meniscuses during the ejection-opening purging operation. In other words, the distance between the platen 10 and the ejection surface 2*a* is set such that the switch of the ejection space S1 from the first isolated state to the second isolated state generates a negative pressure on the air side of the ink meniscuses, the magnitude of which is between the magnitude of the negative pressure generated due to the head difference and the magnitude of the pressure whose absolute value is equal to that of the pressure generated on the ink side of the ink meniscuses during the ejection-opening purging operation and whose polarity is reverse to that of the pressure generated on the ink side of the ink meniscuses during the ejection-opening purging operation.

The switch of the ejection space S1 from the first isolated state to the second isolated state is performed just after the state of the valve 87 is switched from the open state to the closed state in the present embodiment but may be performed at any timing during the ejection-opening purging operation (i.e., from a timing just after the start of the ejection-opening purging operation to a timing just before the end of the ejection-opening purging operation).

In this ejection-opening purging operation, the volume of the amount of ink to be discharged is smaller than a volume by which the ejection space S1 is increased when the ejection space S1 is switched from the first isolated state to the second isolated state. In other words, the distance between the platen 10 and the ejection surface 2*a* is set such that when the ejection space S1 is switched from the first isolated state to the second isolated state, the volume of the ejection space S1 increases by an amount which is larger than the volume of the amount of ink to be discharged in the ejection-opening purging operation. As a result, a predetermined amount of ink can be reliably discharged from the ejection openings 108 in the ejection-opening purging operation.

When a predetermined length of time (i.e., a length of time required for the predetermined amount of ink to be discharged from the ejection openings 108) has passed from the switch of the valve 87 to the closed state, the maintenance control circuit 154 at F6 switches the valve 87 to the open state in the second isolated state of the ejection space S1. As a result, the ink starts flowing through the ink returning tube 83 again, so that an ink pressure in each of the air discharge passage 73 and the ink inlet passage 72 becomes lower than or equal to the meniscus withstanding pressure, and the ejection-opening purging operation ends. That is, the valve 87 is opened at the completion of the ejection-opening purging operation. The maintenance control circuit 154 at F7 stops driving the purging pump 86 just after the valve 87 is opened. When the driving of the purging pump 86 is stopped, the pressure on the ink side of the ink meniscuses becomes a negative pressure due to the head difference. However, since the pressure on the air side of the ink meniscuses is the negative pressure greater than the head difference, foreign matters such as high-viscosity ink attached to the ejection surface 2*a* in the ejection-opening purging operation are not sucked into the ejection openings 108.

After the completion of these purging operations, the maintenance control circuit 154 at F8 switches the state of the valve 59 from the closed state to the open state after switching the state of the valve 87 from the open state to the closed state. As a result, the ink flow is interrupted in the ink returning tube 83. On the other hand, air is allowed to flow through the tube 57, changing the pressure in the ejection space S1 to the atmospheric pressure. Even if the pressure in the ejection space S1 is made the atmospheric pressure, since the valve 87 is in the closed state, the pressure due to the head difference is not applied to the ink side of the ink meniscuses. Accordingly, the foreign matters attached to the ejection surface 2*a* are not sucked into the ejection openings 108.

The maintenance control circuit 154 at F9 drives the up/down motor 48M to move the distal end of the lip member 42 off the upper surface 10*a* of the platen 10, that is, the projecting portion 42*a* is moved from the second contact position to the distant position. As a result, the state of the ejection space S1 is switched to the open state in which the ejection space S1 is open to the outside space S2 (see FIG. 12A). Since air is allowed to flow in the tube 57 before this ejection space S1 is switched to the open state, the state of the ejection space S1 can be easily switched to the open state.

Figure 12B:
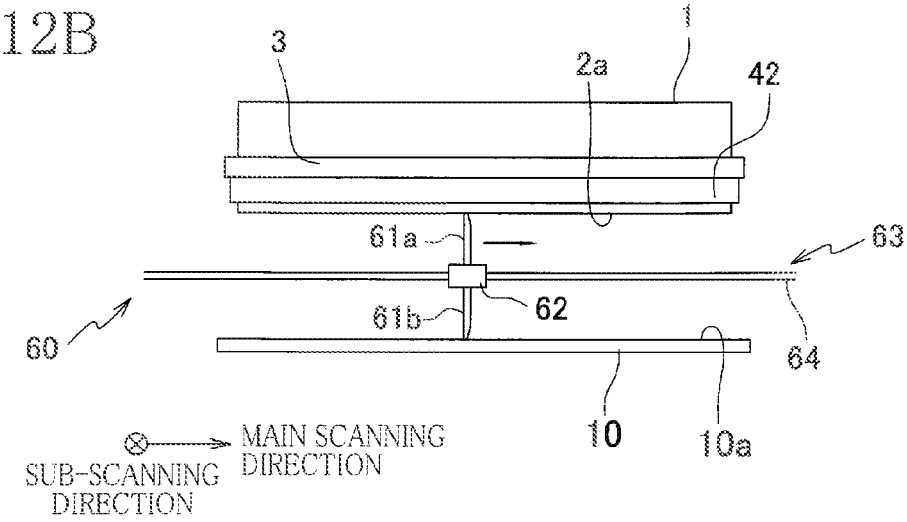

After F9, as illustrated in FIG. 12B, the maintenance control circuit 154 controls the head elevating and lowering mechanism 70 to move the head 1 to the wiping position and controls the platen elevating and lowering mechanism 30 to move the platen 10 to the third position. Thereafter, the maintenance control circuit 154 at F10 controls the drive motor 60M to wipe the ejection surface 2*a* with the wiper 61*a* and wipe the upper surface 10*a* of the platen 10 with the wiper 61*b*. This wiping operation removes foreign matters such as ink from the ejection surface 2*a* and the upper surface 10*a*.

Figure 12C:
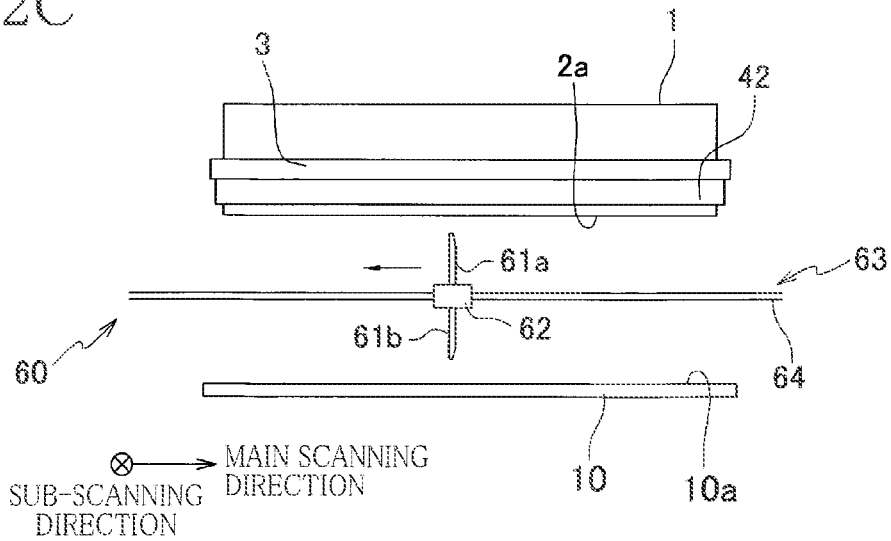

After the wiping, as illustrated in FIG. 12C, the maintenance control circuit 154 controls the head elevating and lowering mechanism 70 to move the head 1 to the upper position, controls the platen elevating and lowering mechanism 30 to move the platen 10 to the fourth position, and controls the drive motor 60M to move the base portion 62 (and the wipers 61*a*, 61*b*) back to the wait position. The maintenance control circuit 154 then controls the head elevating and lowering mechanism 70 to move the head 1 to the recording position and controls the platen elevating and lowering mechanism 30 to move the platen 10 to the first position. The purging operation is finished in this manner, and a printing standby state is established.

Figure 13:
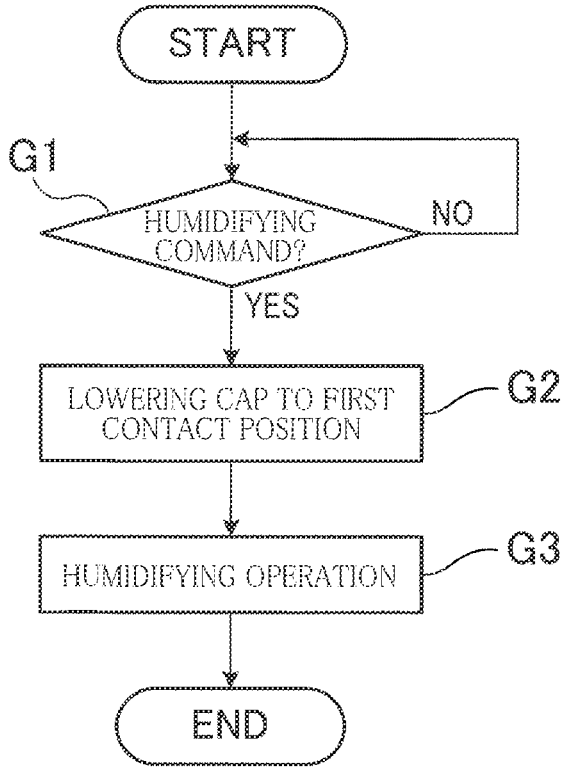
FIG. 13 is a flow chart illustrating processings of a humidifying operation which are executed by the controller of the printer.

There will be next explained, with reference to FIG. 13, processings for the humidifying operation to be executed by the controller 100.

As illustrated in FIG. 13, this flow begins with G1 at which the controller 100 determines whether the humidifying command has been received or not. Before the reception of the humidifying command, the platen 10 is located at the first position, the head 1 at the recording position, and the lip member 42 at the distant position. The pump 56 is at rest, and the valve 59 is open. The conveyor unit 20 is also at rest.

When the humidifying command is received (G1: YES), the controller 100 initially executes the capping operation. In this operation, the maintenance control circuit 154 at G2 drives the up/down motor 48M to bring the distal end of the lip member 42 into contact with the upper surface 10*a* of the platen 10, that is, the projecting portion 42*a* is moved from the distant position to the first contact position. As a result, the state of the ejection space S1 is switched to the first isolated state in which the ejection space S1 is substantially isolated from the outside space S2 (see FIG. 7A). In the case where the valve 59 is in the closed state at this time, the maintenance control circuit 154 controls the valve 59 to open the valve 59.

The maintenance control circuit 154 at G3 performs the humidifying operation for a predetermined length of time by driving the pump 56 to force the humid air from the tank 54 into the ejection space S1 to discharge the air from the ejection space S1. As a result, the humid air is circulated from the tank 54 into the ejection space S1 and from the ejection space S1 into the tank 54, thereby adjusting the humidity of the air in the ejection space S1 to desired humidity. As a result, a degree of drying of the ink in the ejection openings 108 can be reduced.

The humidifying operation is thus finished. When a signal such as the recording command is thereafter received from the external device 97, the controller 100 moves the lip member 42 of the upper surface 10*a*, that is, the projecting portion 42*a* is moved from the first contact position to the distant position. As a result, the state of the ejection space S1 is switched to the open state in which the ejection space S1 is open to the outside space S2, and the image recording operation is performed under the control of the controller 100 as described above.

In the printer 101 according to the present embodiment as described above, foreign matters such as high-viscosity ink are discharged front the ejection openings 108 by the ejection-opening purging operation. In this ejection-opening purging operation, the state of the ejection space S1 is switched from the first isolated state to the second isolated state, which increases the size of the ejection space S1, so that the pressure on the air side of the ink meniscuses (in the ejection space S1) becomes a negative pressure. Accordingly, even when the purging pump 86 is stopped after the completion of the ejection-opening purging operation, and thereby the pressure on the ink side of the ink meniscuses becomes a negative pressure due to the head difference, it is possible to prevent the ink near the ejection openings 108 from being sucked into the ejection openings 108 with the attached foreign matters, resulting in a reduced possibility of failure of ink ejection from the ejection openings 108.

Since the ink returning tube 83 is connected to the sub-tank 80, the ink transferred to the ink returning tube 83 is returned to the sub-tank 80 in the air-bubble purging operation (the ink circulation), resulting in efficient reduction of an mount of waste ink. As a modification, the printer 101 may be configured such that the ink returning tube 83 communicates with a waste liquid tank, not shown, and may be configured such that the ink returning tube 83 communicates selectively with one of the sub-tank 80 and the waste liquid tank. In a first half of the ink circulation, for example, the ink returning tube 83 is fluidically coupled with the waste liquid tank, and ink containing, e.g., foreign matters is discarded. In a latter half of the ink circulation, the ink returning tube 83 is fluidically coupled with the sub-tank 80, and the ink is returned to the sub-tank 80. In at least the latter half of the ink circulation, clean ink is returned to the sub-tank 80. This can reduce an amount of foreign matters accumulating in the sub-tank 80.

The sub-tank 80 is disposed such that a negative pressure (i.e., the negative pressure due to the head difference) is generated on the ink side of the ink meniscuses formed in the ejection openings 108. This configuration can increase the ink supply amount in each of the air-bubble purging operation and the ejection-opening purging operation by an amount corresponding to the generated negative pressure, allowing efficient discharge of the foreign matters from the ink passages.

The distance between the platen 10 and the ejection surface 2*a* is set such that the switch of the ejection space S1 from the first isolated state to the second isolated state generates the negative pressure on the air side of the ink meniscuses, which negative pressure is higher than or equal to the negative pressure generated due to the head difference. This configuration can further prevent the foreign matters attached near the ejection openings 108 from being sucked into the ejection openings 108.

The valve 59 is closed in the purging operation. Thus, even in the case where the printer 101 includes the tube 57 connected to the ejection space S1, the pressure on the air side of the ink meniscuses may be made a negative pressure when the state of the ejection space S1 is switched front the first isolated state to the second isolated state in the ejection-opening purging operation.

Since the tube 57 is connected to the tank 54, the humid air in the tank 54 is delivered into the ejection space S1, and the air in the ejection space S1 is delivered into the tank 54 in the humidifying operation. As a modification, the printer 101 may be configured such that the tube 57 is open to an atmosphere and may be configured such that the tube 57 is connected to the tank 54 or open to the atmosphere, selectively.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, while the air-bubble purging operation (i.e., the liquid transfer operation) is performed in advance of the ejection-opening purging operation in the above-described embodiment, the air-bubble purging operation may not be performed in particular. In this case, the purging pump 86 is driven to transfer the ink, and the valve 87 is closed. These operations achieve the ejection-opening purging operation as in the above-described embodiment. Also, as the cap mechanism 40 which can switch the state of the ejection space S1 selectively to one of the first isolated state, the second isolated state, and the open state, the printer 101 may include: a cap including (a) a bottom portion facing the ejection surface 2*a* and (b) an enclosing portion provided upright on a peripheral portion of the bottom portion and elastically deformable in a direction perpendicular to the ejection surface 2*a*; and a moving mechanism configured to move the cap selectively to one of: a first contact position at which the cap is in contact with a peripheral portion of the ejection surface 2*a* in a state in which the enclosing portion has contracted; a second contact position at which the cap is in contact with the peripheral portion of the ejection surface 2*a* in a state in which the enclosing portion has extended, and the bottom portion is located farther from the ejection surface 2*a* than at the first contact position; and a distant position at which a distal end of the enclosing portion is spaced apart from the head. In the above-described embodiment, when the state of the ejection space S1 is selectively switched between the first isolated state and the second isolated state, the lip member 42 is held in contact with the platen 10 so as to follow the movement of the platen 10 with the elastic deformation of the urging portion 46, but the lip member may be elastically deformed like the urging portion 46 so as to follow the movement of the platen 10. This configuration eliminates the need for providing the urging portion 46.

The humidifying mechanism 50 may not be provided. Also, the wiper unit 60 may not be provided. While the wiper moving mechanism 63 moves the wipers 61*a*, 61*b* in the main scanning direction in the above-described embodiment, the moving mechanism may move the head 1 and may move the wipers 61*a*, 61*b* and the head 1 relative to each other.

The separation distance between the ejection surface 2*a* and the platen 10 may be set such that, when the state of the ejection space S1 is switched from the first isolated state to the second isolated state, the size of the ejection space S1 increases within a range less than or equal to a volume of an amount of ink discharged in the ejection-opening purging operation, or a negative pressure greater than or equal to the negative pressure due to the head difference is generated on the air side of the ink meniscuses.

The present invention is applicable to any of a line printer and a serial printer. Also, the present invention is applicable not only to the printer but also to devices such as a facsimile machine and a copying machine. Furthermore, the present invention is applicable to a liquid ejection apparatus configured to eject liquid other than the ink to perform the recording. The recording medium is not limited to the sheet P, and various recordable media may be used. The present invention may be applied to a liquid ejection apparatus employing any ink ejection method. For example, piezoelectric elements are used in the present embodiment, but various methods may be used such as a resistance heating method and a capacitance method.

What is claimed is:

1. A liquid ejection apparatus, comprising:

a liquid ejection head comprising: an inlet opening through which liquid flows into the liquid ejection head; an outlet opening through which the liquid flows out of the liquid ejection head; an internal passage through which the inlet opening and the outlet opening communicate with each other; an ejection surface formed with a plurality of ejection openings through which the liquid ejection head ejects the liquid; and a plurality of individual liquid passages extending from the internal passage respectively to the plurality of ejection openings;

a first tank configured to store the liquid to be supplied to the liquid ejection head;

a first supply passage through which the first tank and the inlet opening communicate with each other;

a first discharge passage through which the outlet opening and the first tank communicate with each other;

a first pump configured to supply the liquid from the first tank to the internal passage via the first supply passage;

a communication control valve configured to switch a state of the first discharge passage selectively to one of a communicating state in which the first tank and the outlet opening communicate with each other, and an isolating state in which the first tank and the outlet opening are isolated from each other;

a cap mechanism comprising: a facing member which faces the ejection surface, with an ejection space formed between the facing member and the ejection surface; and an elastic member which substantially isolates the ejection space from an outside space by enclosing the ejection space and the plurality of ejection openings with the facing member and the ejection surface, the cap mechanism being configured to switch a state of the ejection space selectively to one of: a first isolated state in which the ejection space is isolated from the outside space by the elastic member; a second isolated state in which the ejection space is isolated from the outside space by the elastic member in a state in which the facing member is spaced apart from the ejection surface by a greater distance than in the first isolated state; and an open state in which the ejection space is opened to the outside space by the elastic member; and a controller configured to control the cap mechanism, the first pump, and the communication control valve to: perform an ejection-opening purging operation for, after establishing the first isolated state of the ejection space, discharging the liquid from the plurality of ejection openings by establishing the isolating state of the first discharge passage in a state in which the liquid in the first tank is being supplied to the internal passage by the first pump; and after a completion of the ejection-opening purging operation, stop the liquid in the first tank from being supplied to the internal passage, the controller being configured to control the cap mechanism in the ejection-opening purging operation to switch the state of the ejection space from the first isolated state to the second isolated state.

2. The liquid ejection apparatus according to claim 1, wherein the controller is configured to control the communication control valve to switch the state of the first discharge passage to the communicating state at the completion of the ejection-opening purging operation.

3. The liquid ejection apparatus according to claim 1, wherein the controller is configured to control the communication control valve to switch the state of the first discharge passage from the isolating state to the communicating state when the ejection space is in the second isolated state.

4. The liquid ejection apparatus according to claim 1, wherein the first tank and the plurality of ejection openings communicate with each other, and wherein the liquid ejection head is disposed at a position at which a pressure on a liquid side of liquid meniscuses formed in the plurality of ejection openings is negative with respect to a pressure on a liquid side of a liquid surface of the liquid in the first tank.

5. The liquid ejection apparatus according to claim 1, wherein a separation distance between the ejection surface and the facing member in each of the first isolated state and the second isolated state is set such that, when the state of the ejection space is switched from the first isolated state to the second isolated state, a size of the ejection space increases by an amount corresponding to a volume of the liquid to be discharged in the ejection-opening purging operation.

6. The liquid ejection apparatus according to claim 5, wherein the separation distance in each of the first isolated state and the second isolated state is set such that a negative pressure on an air side of liquid meniscuses formed in the plurality of ejection openings in the second isolated state is greater than or equal to a negative pressure generated on a liquid side of the liquid meniscuses due to a positional relationship between the first tank and the liquid ejection head and less than a pressure whose absolute value is equal to that of a pressure generated on a liquid side of liquid meniscuses formed in the plurality of ejection openings in the ejection-opening purging operation and whose polarity is reverse to that of the pressure generated on the liquid side of the liquid meniscuses formed in the plurality of ejection openings in the ejection-opening purging operation.

7. The liquid ejection apparatus according to claim 1, further comprising:

a second discharge passage connected to the ejection space; and an air cut-off valve capable of interrupting a flow of air through the second discharge passage, wherein the controller is configured to control the air cut-off valve to interrupt the flow of the air through the second discharge passage in the ejection-opening purging operation.

8. The liquid ejection apparatus according to claim 7, wherein the controller is configured to: stop the liquid in the first tank from being supplied to the internal passage; thereafter switch the state of the first discharge passage to the isolating state; thereafter control the air cut-off valve to cause air in the second discharge passage to flow; and thereafter control the cap mechanism to switch the state of the ejection space to the open state.

9. The liquid ejection apparatus according to claim 8, further comprising:

a wiper configured to wipe the ejection surface; and a moving mechanism configured to move at least one of the wiper and the liquid ejection head such that the wiper moves relative to the ejection surface in a state in which the wiper is in contact with the ejection surface, wherein the controller is configured to control the moving mechanism to cause the wiper to wipe the ejection surface after the state of the ejection space is switched to the open state after the completion of the ejection-opening purging operation.

10. The liquid ejection apparatus according to claim 9, further comprising:

a second tank configured to store humid air to be supplied to the ejection space;

a second supply passage connected to the ejection space; and a second pump configured to supply the humid air stored in the second tank, to the ejection space via the second supply passage, wherein the controller is configured to perform a humidifying operation for transferring the humid air from the second tank to the second supply passage, the ejection space, and the second discharge passage in order in a state in which the ejection space is in the first isolated state.

11. The liquid ejection apparatus according to claim 10, wherein the second discharge passage is configured to establish a communication between the second tank and the ejection space.

12. The liquid ejection apparatus according to claim 1, wherein the controller is configured to perform a liquid transfer operation in advance of the ejection-opening purging operation, with the ejection space being in the first isolated state, and wherein the liquid stored in the first tank is transferred through the first supply passage, the internal passage, and the first discharge passage in order in the liquid transfer operation such that a predetermined magnitude of a negative pressure less than a withstanding pressure of the liquid meniscuses which is a maximum pressure that does not break liquid meniscuses formed in the plurality of ejection openings is generated on a liquid side of the liquid meniscuses.

13. The liquid ejection apparatus according to claim 12, wherein the controller is configured to switch the state of the first discharge passage to the communicating state in the liquid transfer operation, with the ejection space being in the first isolated state.

14. The liquid ejection apparatus according to claim 12, wherein the controller is configured to, in the liquid transfer operation, change the state of the first discharge passage from the communicating state to the isolating state to finish the liquid transfer operation and start the ejection-opening purging operation.

15. The liquid ejection apparatus according to claim 12, wherein the controller is configured to transfer the liquid from the first tank in the ejection-opening purging operation and the liquid transfer operation with the same force.

16. The liquid ejection apparatus according to claim 1, wherein the controller is configured to control the cap mechanism to switch the state of the ejection space from the first isolated state to the second isolated state in a part of a period in which the ejection-opening purging operation is performed.

* * * * *